US005353925A

United States Patent [19]

Lennen et al.

[11] Patent Number: 5,353,925

[45] Date of Patent: Oct. 11, 1994

[54] PRESERVATION METHOD AND DEVICE FOR A COLLECTABLE ARTICLE

[75] Inventors: Christopher K. Lennen, 352 Elwood St., Redwood City, Calif. 94062; Richard A. Lennen, Campbell, Calif.; Rory W. Fuerst, Atherton, Calif.; Horace C. Jones, Mountain View, Calif.

[73] Assignee: Christopher K. Lennen, Redwood City, Calif.

[21] Appl. No.: 84,762

[22] Filed: Jun. 28, 1993

Related U.S. Application Data

[63] Continuation of Ser. No. 856,471, Mar. 24, 1992, abandoned.

[51] Int. Cl.[5] ..... B65D 81/26

[52] U.S. Cl. ..... 206/204; 206/1.7; 206/205; 206/424; 206/588

[58] Field of Search ..... 206/1.7–1.9, 206/204, 205, 213.1, 449, 451, 453–456, 588, 424; 40/1, 152, 156, 158.1, 159

[56] References Cited

U.S. PATENT DOCUMENTS

| | | | |
|---|---|---|---|
| 764,273 | 7/1904 | Denton et al. | 206/449 |
| 1,890,467 | 12/1932 | McCarroll | 206/451 |
| 2,524,162 | 10/1950 | Chavannes et al. | 312/31 |
| 2,742,145 | 4/1956 | Blackburn | 206/449 |
| 2,746,667 | 5/1956 | Murphy | 206/588 |
| 2,895,599 | 7/1959 | Moyer et al. | 206/454 |
| 2,950,001 | 8/1960 | Bucko | 206/454 |
| 3,040,080 | 6/1962 | Acker | 206/451 |
| 3,344,917 | 10/1967 | Raffet | 206/451 |
| 3,655,034 | 4/1972 | Stollman et al. | 206/454 |
| 3,707,053 | 12/1972 | Itano | 40/158.1 |
| 3,826,358 | 7/1974 | Butler et al. | 206/204 |
| 4,413,424 | 11/1983 | Rupert et al. | 40/10 R |
| 4,444,306 | 4/1984 | Benaquista | 206/1.7 |
| 4,646,914 | 3/1987 | Gipson | 206/45.34 |
| 4,869,369 | 9/1989 | Turngren | 206/453 |
| 4,892,193 | 1/1990 | Thomas | 206/453 |
| 4,955,153 | 9/1990 | Albrecht et al. | 40/661 |
| 4,984,798 | 1/1991 | Silberstein | 40/156 |
| 5,012,601 | 5/1991 | Garland et al. | 40/156 |
| 5,038,926 | 8/1991 | van der Toorn | 206/39.3 |
| 5,040,671 | 8/1991 | Hager | 206/39 |
| 5,074,593 | 12/1991 | Grosso | 283/77 |
| 5,130,825 | 7/1992 | Kok-Schram De Jong | 40/152 |

FOREIGN PATENT DOCUMENTS

| | | | |
|---|---|---|---|
| 0218842 | 2/1968 | Sweden | 40/152 |
| 0208287 | 12/1923 | United Kingdom | 206/449 |
| 0286165 | 3/1928 | United Kingdom | 40/152 |
| 0452513 | 8/1936 | United Kingdom | 206/451 |

*Primary Examiner*—Jimmy G. Foster
*Attorney, Agent, or Firm*—Flehr, Hohbach, Test, Albritton & Herbert

[57] ABSTRACT

A device for preserving a collectable article is disclosed. The device includes front and back panel members at least partially defining a cavity for receiving a collectable article. The device is formed for exposing the gaseous substance within the cavity to a desiccant. Additionally, an aspect of the present invention includes at least one spacing sheet positioned between the panel members for adjusting the height of the cavity. Another aspect of the present invention includes at least one tab protruding into the cavity for positioning the collectable article therein to form a channel around the article.

11 Claims, 3 Drawing Sheets

PRESERVATION METHOD AND DEVICE FOR A COLLECTABLE ARTICLE

This is a continuation, of application Ser. No. 07/856,471 filed mar. 24, 1992, abandoned.

BACKGROUND OF THE INVENTION

In general, the present invention relates to a protective device for retaining an article. More particularly, the present invention relates to a device for preserving collectable articles.

Collecting comic books is rapidly becoming a quite lucrative endeavor. A comic book which after a period of time remains in excellent condition will draw several thousand dollars when sold. If the pages have become yellowed, stained, bent or torn the value is significantly reduced. Similarly, with other collectable items such as books, magazines, photographs, paintings, stamps and other paper products, the item's value will dramatically increase over time only if preserved in its original condition.

To maintain the item in excellent condition as it ages, the collector must take precautions to protect the item from mold, fungi and other damaging elements. The item should be stored in a manner which prevents bending or tearing. Acids which are absorbed into the material are particularly destructive, causing stains, brittleness and bleaching of dyes. As time passes, the acidity will spread from one material to another. Thus, the collectable article must be isolated from acid-forming and acid-containing elements.

Air contains several impurities which are easily converted into acids. Sulfur dioxide, released into the atmosphere by the combustion of fuel, will react with moisture and trace elements of iron or copper to form sulfuric acid. Hydrogen sulfide, ammonia, ozone and nitrogen dioxide will react with water vapor to form acids or other destructive chemicals. Similarly, many containers used for storage are formed of materials containing acids or acid-forming elements. The water vapor present in the air provides sufficient moisture to stimulate mold growth and to convert impurities in the air into damaging chemicals and acids. For optimum preservation, the collectable article must be substantially protected from the harmful effects of the air.

One method of protecting a collectable article from the deteriorating elements in the environment is to store the item in a flexible bag formed of a suitable plastic, such as polyethylene or polypropylene. The bag protects against damage such as that caused by excess moisture, dirt, and impurities found in the air, reducing the deterioration of the article. However, the plastics contain contaminants which will in time be absorbed by the item, damaging the article and substantially lowering its value. The bag may alternatively be formed of a film of an archival-quality polyester resin, which does not contain the contaminants found in the other plastics. The material in addition resists moisture, pollutants and acids. One example of an archival-quality film is MYLAR TYPE D by DuPont.

The added protection from contaminants provided by the polyester film bag reduces the amount of deterioration over time. However, a flexible bag will not protect the article from other damaging forces. Oxygen will slowly pass through the plastic, oxidizing the paper pages. Additionally, the flexible container does not provide sufficient support to adequately protect the item from bending or tearing. If the bag is not properly sealed, air will freely pass into the container, introducing moisture vapor for catalyzing the formation of acids and stimulating mold growth.

Alternatively, the collectable article may be retained within a sealed container to protect the article from destructive elements, such as those present in air. U.S. Pat. Nos. 4,646,914 and 5,040,671 teach enclosures for protecting a flat collectable item. The disclosed enclosures prevent bending or tearing of the flat items. Permanently sealing the containers reduces the access of moisture and other damaging contaminants to the item. However, as with the flexible bag, impurities within the container material will eventually migrate to the item, causing discoloration and substantially reducing the value of the item. If the collector wishes to remove the article from the protective container, he has to break the seal, potentially damaging the container. The container would have to be resealed after the item is replaced. This process is inefficient, and increases the cost of preserving the collectable article. In addition, the disclosed enclosures are for flat collectable items or art objects; they are not particularly suitable for thicker items such as comics, books, and magazines.

A percentage of moisture is retained within the fibers forming the collectable article. Similarly, moisture has been captured within the material forming the container. As time passes and storage conditions change, the moisture will escape from the fibers into the container. Thus, a certain percentage of moisture will be present even in a sealed container. Desiccant has been used in packing for absorbing excess moisture or oxygen for preservation. The sealed container in U.S. Pat. No. 4,646,914 includes a desiccant added to the back panel of the enclosure for absorbing the water vapor. By exposing the gaseous substance within the enclosure to the desiccant, the excess moisture will be absorbed. The excess moisture escaping from the fibers must be removed from the entire item to sufficiently protect the article from damage. In the disclosed enclosure, the desiccant is separated from the object by a mounting board, reducing the effectiveness of the desiccant. Thus, some water vapor will remain in contact with the object. For maximum protection, the desiccant must be exposed to the gaseous substance in immediate contact with the collectable article.

The devices available in the prior art for preserving a collectable article provide protection against many of the destructive elements which induce deterioration of the item over time. However, a protective device which substantially prevents destruction caused by moisture, oxygen and contaminants such as acids while preventing bending or tearing of the item, is desirable. A protective device which preserves a collectable article without providing a permanently sealed environment is additionally desirable. A protective device which may be adapted to retain a collectable article independent of its thickness is also desirable. Additionally, a device which maximizes exposure of any gaseous substance within the device or within the article itself to a desiccant is similarly desirable.

SUMMARY OF THE INVENTION

The present invention provides a protective device for preserving a collectable article in excellent condition as it ages. It has many different features responsible for its efficacy. In one aspect, the present invention includes front and back panel members which at least partially define a cavity for receiving a collectable article. It also includes means for exposing the gaseous substance within the cavity to a desiccant, such as a recess opening within the cavity and at least partially defined by one of the panel members. In another aspect of the present invention, the front and back panel members are substantially rigid, sandwiching the collectable article therebetween and maintaining its shape. The rigidity of the panel members preserves the flat shape of a comic book, and prevents any bending or tearing of the pages.

In additional aspects of the present invention, at least one spacing sheet is positioned between the front and back panel members for adjusting the height of the cavity. In this manner the protective device of the present invention may be adapted to retain comic books of different thicknesses or different-sized collectable articles. Moreover, the protective device may be used for preserving different types of articles, such as photographs, comic books, magazines and books. A tab protrudes into the cavity for positioning the article to form a channel for the circulation of a gaseous substance around the article. When a desiccant is added to the device, the channel maximizes the effectiveness of the desiccant by efficiently exposing the desiccant to any gases within the cavity.

The protective device of the present invention has several advantages. The device effectively preserves a collectable article, protecting against contaminants, bending and tearing, oxidation, moisture and other destructive elements. The cavity need not be permanently sealed, allowing the article to be easily inserted into and withdrawn from the device. The size of the cavity within the device may be conveniently adjusted to accommodate differently sized objects, increasing the versatility of the device. By providing a circulation channel, the presence of moisture in contact with the article is substantially eliminated, further improving the aging of the collectable article. Additional features and advantages of the present invention will be more readily apparent from the following detailed description when taken in conjunction with the included drawings.

DETAILED DESCRIPTION OF THE PREFERRED EMBODIMENTS

Figure 1:
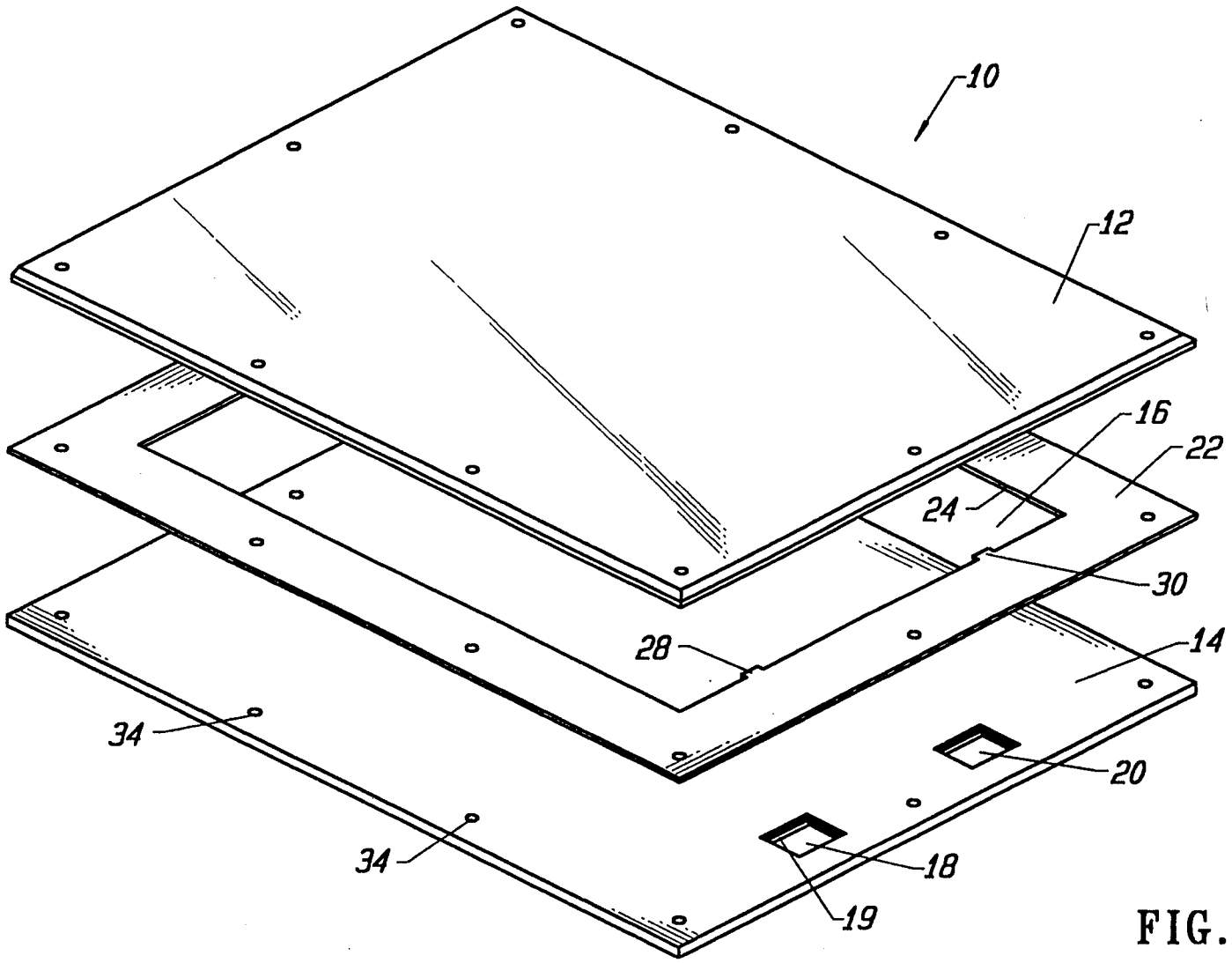
FIG. 1 depicts an exploded isometric view of a protective device designed in accordance with the present invention.

Reference will now be made in detail to the preferred embodiments of the invention illustrated in the accompanying figures. Turning now to the drawings, wherein like components are designated by like reference numerals throughout the various figures, attention is first directed to FIGS. 1–4.

A protective device 10 designed in accordance with the present invention to protect a collectable item from the harmful aging effects of dirt, moisture, insects and other destructive elements is shown in FIG. 1. Front and back panel members 12 and 14 are provided as the main parts of the device. The panel members at least partially define a cavity 16 for receiving collectable article 11. In the preferred embodiment, protective device 10 is specifically designed for preserving a comic book. The front and back panel members are substantially rigid, preventing undesirable bending or curling of the comic book. While the panel members are substantially planar in the preferred form, the specific structure of front and back panel members 12 and 14 may be tailored according to the geometry of the collectable item. For example, panel members having a curved or domed shaped may be desired for protecting a particularly thick book or manuscript.

Front panel member 12 is substantially transparent for displaying the article retained within the cavity. The back panel member may also be formed of a substantially transparent material. Thus, a portion of the collectable article, for example the cover of a comic book or magazine, is displayed as the item is preserved. The collector may view the article without removing it from cavity 16. In the present embodiment, the panel members are formed of polystyrene. However, another suitable transparent plastic or alternatively a substantially opaque material may be substituted for the polystyrene.

In one aspect of the present invention, protective device 10 is formed having means for exposing the gaseous substance within cavity 16 to a desiccant, such as a recess 18, to preserve a collectable article 11. The recess is at least partially defined by one of the panel members. A shelf or desiccant lock 19 is formed for retaining the desiccant within the recess and preventing contact between the desiccant and the collectable article. As is shown in FIG. 1, back panel member 14 is formed having two recesses 18 and 20. However, the number of recess included may be altered to account for the varied size and moisture content found in different collectable items. Similarly, recesses 18 and 20 may be substituted with other suitable means, such as a channel formed in between the panel members for retaining a desiccant.

Recesses 18 and 20 at least partially open into the cavity, thereby exposing the gaseous substance to a desiccant retained within either of the recesses, as is generally indicated by the interrupted lines. The presence of excess moisture will stimulate the growth of mold and fungi, and the conversion of sulfur dioxide and other contaminants into acids. Exposing the gaseous substance within the cavity to a moisture-absorbing desiccant substantially protects the collectable article from these damaging effects. The water vapor present in the air which filters into the cavity and which is present within the collectable article will be absorbed by the desiccant. Thus, the protective device of the present invention is easy to manufacture and use in that the cavity need not be impervious to air. Since the item is not permanently sealed within cavity 16, the collector may remove the collectable item without destroying the protective device. Similarly, the desiccant retained within either of the recesses may be conveniently replaced when saturated.

While the desiccants most commonly used are for absorbing moisture, other desiccants having different uses are also available. For example, an oxygen-absorbing desiccant may be retained within recess 18 to inhibit the oxidation of collectable article 11. Protective device 10 therefore need not be formed of a material which is completely impervious to oxygen. Any oxygen filtering into the cavity would be absorbed by the desiccant prior to the occurrence of oxidation.

In another aspect of the present embodiment, the protective device also includes means for adjusting the height of cavity 16, such as a spacing member or sheet 22 positioned between panel members 12 and 14 and having a central opening 24. The height of cavity 16 is defined by the thickness of spacing sheet 22. By introducing the spacing sheet between the panel members, a collectable item having a certain degree of thickness, such as a comic book or a magazine, may be positioned within the cavity. To further increase the height of the cavity to accommodate thicker comics or other collectable articles, additional spacing sheets may be positioned between the panel members, as is discussed in more detail in relation to FIG. 5. Similarly, spacing sheet 22 may be replaced by several substantially thin spacing sheets. The protective device of the present invention is quite versatile, since the height of the cavity may conveniently be adjusted by the number of spacing sheets positioned between the panel members.

In the preferred embodiment, front and back panel members 12 and 14 are substantially planar, with the cavity height primarily provided by the thickness of spacing sheet 22. Although not shown, in alternative embodiments of the present invention the panel members may include inturned flanges along the outer perimeter which contribute to the height of the cavity. In this instance the addition of a single spacing member would increase the height of the cavity. Similarly, other suitable means may be used for adjusting the height of the cavity, such as incorporating an accordion-type member between the panel members.

To completely preserve collectable article 11 against contamination by destructive elements, spacing member 22 may be formed of a nonacidic or acid-free material. Alternatively, an archival-quality material having an alkaline buffer for resisting the formation of acid may be substituted. These materials are preferable, since they substantially isolate the item from acid and similar contaminants. However, if this maximum protection is not essential for preserving a particular item, other materials may be substituted.

In yet another aspect of the present invention, protective device 10 includes means for forming a channel 26 around collectable article 11, such as at least one tab 28 protruding into cavity 16. Tab 28 retains the collectable item within the cavity to form channel 26 for the circulation of the gaseous substance throughout the cavity. The channel reduces the contact between collectable article 11 and spacing member 22, minimizing the possible migration of potentially destructive elements from the spacing member. In addition, the channel exposes the edges of the comic book, providing an indication of the condition of the article. Allowing the gases to freely circulate throughout the cavity improves the effectiveness of a desiccant contained within device 10. Water vapor or oxygen within the cavity will be transported to the desiccant for absorption by the circulating gases. Thus, with the present invention the formation of moisture pockets on the item is substantially prevented since the collectable item is effectively exposed to the desiccant.

Figure 2:
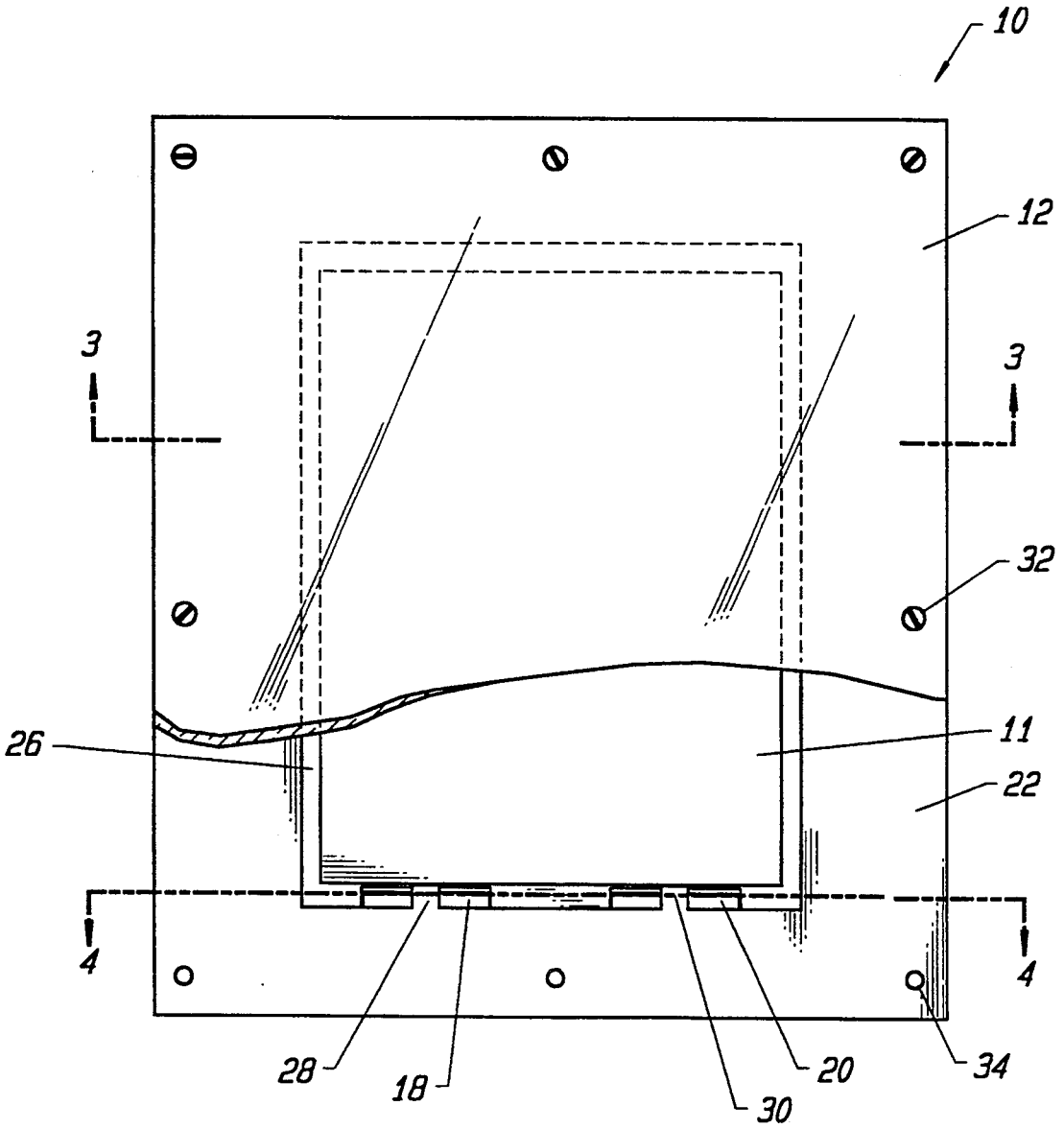
FIG. 2 depicts a top plan view of the protective device of FIG. 1, shown with the front panel member partially broken away and a collectable article positioned in the cavity.
Figure 3:
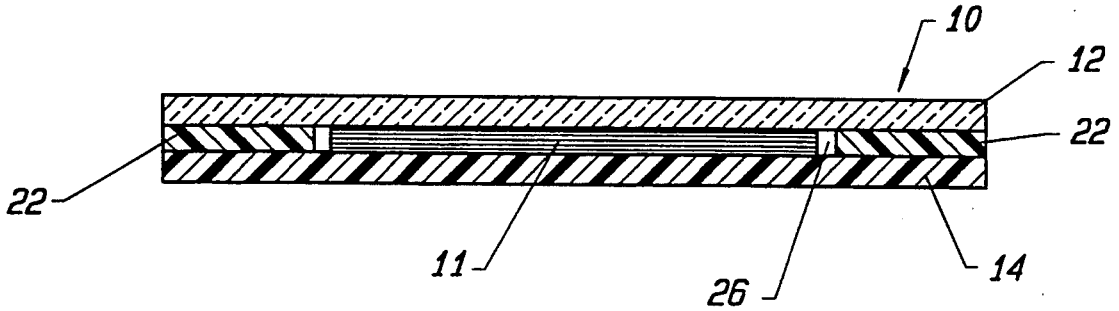
FIG. 3 depicts a frontal cross sectional view taken along line 3—3 of FIG. 2.
Figure 4:
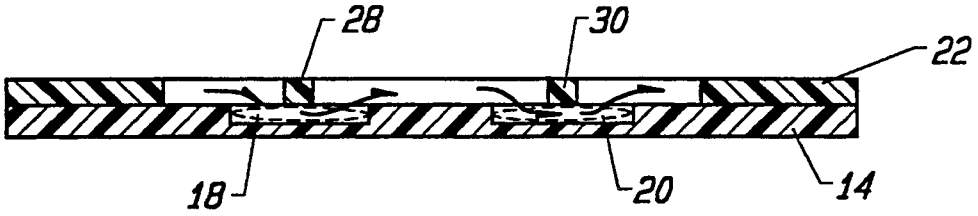
FIG. 4 depicts a frontal cross sectional view taken along line 4—4 of FIG. 2.

As is shown in FIG. 2 and 4, tabs 28 and 30 extend across recesses 18 and 20. With this configuration, the tabs essentially guide the gas flow into the recess and across the desiccant, as is generally indicated by the directional arrows in FIG. 4. The effectiveness of the desiccant is substantially increased, since the desiccant is included within the gas flow path. The tabs do not interrupt the circulation of gases around article 11, but rather increase the exposure of the desiccant by directing the gaseous substance into recesses 18 and 20.

By substantially improving the effectiveness of a desiccant, a permanent sealing of the cavity against penetrating gases is not required with the present invention. The moisture present in air will be quickly and efficiently absorbed by the desiccant before causing any destructive effects. Similarly, incorporating an oxygen-absorbing desiccant will prohibit the oxidation of the collectable article.

The two tabs 28 and 30 of the present embodiment are integrally formed with spacing member 22. In alternative embodiments, the number and location of the tabs provided for positioning the article within the cavity may be varied. In addition, the tabs may be integrally formed with one of the panel members instead of spacing member 14. While in the present embodiment the tabs extend along the entire thickness of spacing member 22, the tab height may be reduced to facilitate circulation within channel 26. Alternatively, other suitable means for forming a channel may be incorporated.

To preserve a collectable item, article 11 is positioned within central opening 24, which partially defines cavity 16. If desired, a quantity of moisture-absorbing or oxygen-absorbing desiccant is inserted into recesses 18 and 20. Front panel member 12 is placed over the collectable article, and secured to back panel member 14 by inserting screws 32 through threaded holes 34. To remove the article from the cavity, the protective device is opened by removing the screws from the threaded holes. In this manner, the collectable article may be conveniently removed from the protective device without damaging the device. When the desiccant becomes fully saturated, a fresh sample may also be easily substituted. Other means for securing the panel members together may be incorporated in place of the screw and threaded hole combination, for example by tightening an adjustable strap around the panel members.

Figure 5:
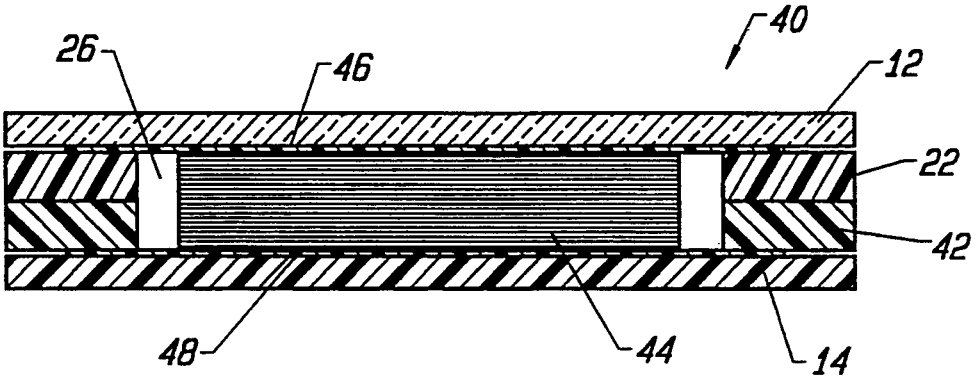
FIG. 5 depicts a frontal cross sectional view of an alternative embodiment of a protective device in accordance with the present invention, shown with a collectable article positioned within the cavity.

An alternative embodiment of protective device 40 designed in accordance with the present invention is shown in cross section in FIG. 5. In this embodiment, a second spacing sheet 42 has been positioned between panel members 12 and 14, increasing the height of cavity 16. A collectable article 44 having a substantial thickness is positioned within the cavity. By adding the second spacing sheet, the height of the cavity has been increased by an appropriate amount for receiving a larger collectable item, such as a thicker comic book. Several spacing members may be used if an even larger cavity is desired.

By adding or removing spacing sheets from between front and back panel members 12 and 14, the height of cavity 16 may conveniently be adjusted. The protective device is adaptable for preserving collectable items of varied sizes. For example, a collector may use protective device 10 for preserving one collectable item, such as a comic book, and then later position a larger item, such as a thicker comic or other type of collectable article, within the same protective device. Thus, using spacing sheets for adjusting the height of the cavity provides a versatile, cost efficient protective device for preserving collectable articles.

In the illustrated embodiment, spacing members 22 and 42 are substantially identical. However, it is to be understood that spacing sheets of a different size and thickness may be incorporated in the present invention. Each spacing member may have an integrally formed tab for positioning the collectable article within the cavity. Alternatively, the tab may be included on only one of the spacing sheets, with the gas flow being directed around the tab.

Collectable article 44 is separated from panel members 12 and 14 by at least one respective layer of protective material 46 and 48. For maximum protection, the layer is formed of a film of an archival-quality polyester resin which is substantially resistant to the passage of moisture, acid, dirt and other impurities. One example of an archival-quality film is MYLAR TYPE D by DuPont. The protective material is selected to prevent the penetration of acids or other contaminants from the panel members to the collectable article. Thus, if a panel member becomes contaminated by an acid or other impurities, the layer of protective material will preserve the article. Moreover, the use of protective layers provides versatility in selecting materials for the panel members. It is desirable that protective layers, such as layers 46 and 48, be positioned between the article and the panel members to completely preserve a comic book against contamination by destructive elements.

What is claimed is:

1. A device adapted for preserving a collectable article, comprising:

(a) a front panel;

(b) a back panel;

(c) a spacing sheet sandwiched between said front and back panels, which sheet includes a peripheral interior edge, said interior edge together with said front and back panels defining a cavity for receiving said article, positioning means on said interior edge for positioning and retaining said article spaced from said edge when said article is located in said cavity, in order to create a channel between said article and said edge;

(d) exposing means in gaseous communication with said channel when the article is in said cavity; and (e) a desiccant contained within a recess for absorbing moisture vapor from a gaseous substance.

2. A device adapted for preserving a collectable article, comprising:

(a) a front panel;

(b) a back panel;

(c) a spacing sheet sandwiched between said front and back panels, which sheet includes a peripheral interior edge, said interior edge together with said front and back panels defining a cavity for receiving said article, positioning means on said interior edge for positioning and retaining said article spaced from said edge when said article is located in said cavity, in order to create a channel between said article and said edge;

(d) exposing means in gaseous communication with said channel when the article is in said cavity; and (e) a desiccant contained within a recess for absorbing oxygen from a gaseous substance.

3. A device adapted for preserving a collectable article, comprising:

(a) a front panel;

(b) a back panel;

(c) a spacing sheet sandwiched between said front and back panels, which sheet includes a peripheral interior edge, said interior edge together with said front and back panels defining a cavity for receiving said article, positioning means on said interior edge for positioning and retaining said article spaced from said edge when said article is located in said cavity in order to create a channel between said article and said edge and (d) exposing means in gaseous communication with said channel when the article is in said cavity, said exposing means including at least one recess in one of said panels which is partially coextensive with said cavity and partially coextensive with the width of said spacing sheet, said recess being adapted to be in gaseous communication with said channel when said article is in said cavity.

4. The device of claim 3 wherein said positioning means includes a tab protruding into said cavity for positioning said article within said cavity with said channel formed substantially around said article.

5. The device of claim 3 further comprising a layer of protective material for separating said article from an associated one of said panels.

6. The device of claim 5 wherein said protective material is formed of an archival-quality polyester film.

7. The device of claim 3 wherein at least one of said panels is substantially transparent at said cavity for displaying said article being retained within said cavity.

8. The device of claim 3 wherein said panels are formed of polystyrene.

9. The device of claim 3 wherein said panels are substantially rigid.

10. The device of claim 3 wherein said panels are substantially planar.

11. The device of claim 3 wherein said spacing sheet is formed of a nonacidic material.

* * * * *